US009554605B2

(12) United States Patent
Burnet et al.

(10) Patent No.: US 9,554,605 B2
(45) Date of Patent: Jan. 31, 2017

(54) HAT

(75) Inventors: Richard John Stacey Burnet, Nottingham (GB); Paul David Michael Parsons, Nottingham (GB); Keith Gordon Simpkin, Nottingham (GB)

(73) Assignee: Aburnet Limited, Derbyshire (GB)

( * ) Notice: Subject to any disclaimer, the term of this patent is extended or adjusted under 35 U.S.C. 154(b) by 891 days.

(21) Appl. No.: 13/995,729

(22) PCT Filed: Dec. 21, 2011

(86) PCT No.: PCT/GB2011/052552

§ 371 (c)(1),
(2), (4) Date: Jun. 19, 2013

(87) PCT Pub. No.: WO2012/085576

PCT Pub. Date: Jun. 28, 2012

(65) Prior Publication Data

US 2013/0263357 A1 Oct. 10, 2013

(30) Foreign Application Priority Data

Dec. 24, 2010 (GB) ..... 1021948.3

(51) Int. Cl.

| | |
|---|---|
| ***A42B 1/04*** | (2006.01) |
| ***A42B 1/20*** | (2006.01) |
| ***A42C 1/00*** | (2006.01) |

(52) U.S. Cl.

CPC ..... *A42B 1/041* (2013.01); *A42B 1/043* (2013.01); *A42B 1/208* (2013.01); *A42C 1/00* (2013.01)

(58) Field of Classification Search

CPC ..... A42B 1/041; A42B 1/043; A42B 1/208; A42C 1/00

See application file for complete search history.

(56) References Cited

U.S. PATENT DOCUMENTS 2,859,447 A * 11/1958 De Villers ..... A42B 1/043 2/195.7
3,710,396 A * 1/1973 Tomlinson ..... A42B 1/043 2/200.3

(Continued)

FOREIGN PATENT DOCUMENTS

DE 7229925 U 6/1973
DE 2416382 A1 2/1975

(Continued)

OTHER PUBLICATIONS

International Preliminary Report on Patentability dated Jun. 25, 2013, from corresponding International Application No. PCT/GB2011/052552 filed Dec. 21, 2011.

*Primary Examiner* — Shaun R Hurley
*Assistant Examiner* — Andrew W Sutton
(74) *Attorney, Agent, or Firm* — Young Basile Hanlon & MacFarlane, P.C.

(57) ABSTRACT

Provided is a hat formed from a single piece of fabric. The single piece of fabric comprises parallel regions of fabric including first and second headband regions and at least one intermediate region. The headband regions are joined at their ends to form a headband and the intermediate region forms the crown of the hat. The headband regions and the at least one intermediate region are of differing stiffness and/or thickness.

26 Claims, 8 Drawing Sheets

(56) References Cited

U.S. PATENT DOCUMENTS

| | | | | | |
|---|---|---|---|---|---|
| 4,186,446 | A * | 2/1980 | Maney | A42B 1/043 | 2/200.3 |
| 4,213,206 | A * | 7/1980 | Maney | A42B 1/043 | 2/200.3 |
| 4,485,495 | A * | 12/1984 | Lunt | A42B 1/041 | 2/195.2 |
| 4,651,352 | A * | 3/1987 | Ranzer | A42B 1/043 | 2/200.3 |
| 6,738,986 | B1 * | 5/2004 | Martin | A42B 1/241 | 2/171 |
| 2011/0272605 | A1 * | 11/2011 | Cohen | A42B 1/008 | 250/516.1 |

FOREIGN PATENT DOCUMENTS

| | | | |
|---|---|---|---|
| GB | 962355 | A | 7/1964 |
| GB | 1129863 | A | 10/1968 |
| GB | 1591721 | A | 6/1981 |
| GB | 2328364 | A | 2/1999 |

* cited by examiner

HAT

The present invention relates to hats, and especially to hats for use as protective headwear for hygienic purposes in catering and retail establishments, factories and the like, and other establishments in which hygiene is of importance such as hospitals and other health service establishments, and/or hats intended to carry branding or other promotional information. The invention may also find application in the production of headwear worn for religious purposes, eg at places of worship. In particular it relates to hats which may be produced in an automated process from a single piece of fabric.

In workplaces such as catering establishments and factories where foodstuffs are manufactured and/or packaged, or pharmaceutical or cosmetic manufacturing establishments, it is often a requirement that workers keep their hair covered at all times for reasons of hygiene. Hats worn for that purpose may need to be replaced regularly as they become damaged or soiled. It is therefore important that such hats can be produced at low cost and in large numbers. It is also important that such hats should be so designed that employees are not reluctant to wear them and, especially in environments in which the wearer of the hat may be seen by members of the public, eg in fast food establishments, that the hat conveys an appropriate visual impression. In particular, the hat should be suitable for corporate branding.

Conventionally, such headwear is produced in so-called cut/make/trim (CMT) processes. Typically, this involves cutting a blank from a suitable fabric, forming the blank into the desired shape, fastening it in that shape (eg by stitching or by adhesive) and then trimming to give the final product. This manner of production cannot be fully automated, with the result that it is labour-intensive and relatively slow, increasing the cost of production and so the cost of the final product. This is not suitable for a situation where large numbers of hats are needed and are replaced on a frequent basis. In addition, making headwear out of very lightweight material, for example a mesh fabric, using the CMT process presents numerous difficulties, as sewing very lightweight material, if it is not impossible, rarely produces neat seams and an attractive final product. The use of a material that can be sewn relatively easily and which is stiff and substantial enough for the hat to adopt the desired shape, results in a hat that may prove to be uncomfortably warm, which may again lead to a wearer removing the hat and so failing to comply with hygiene regulations.

Other forms of hat that are used in such situations are relatively simple paper products. The manufacture of such paper hats again involves several steps, and the products may be supplied in a way that requires the user to assemble the hat into its final form. Such paper hats may also be rather stiff and uncomfortable to wear. Similar issues arise where materials other than paper, eg non-woven fabrics, are used.

There has now been devised an improved hat which overcomes or substantially mitigates the above-mentioned and/or other problems associated with the prior art. The invention also provides an improved method of producing such hats.

According to a first aspect of the invention, there is provided a hat formed from a single piece of fabric, the single piece of fabric comprising parallel regions of fabric including first and second headband regions and at least one intermediate region, the headband regions being joined at their ends to form a headband and the intermediate region forming the crown of the hat, wherein the headband regions and the at least one intermediate region are of differing stiffness and/or thickness.

The hat according to the invention is advantageous in that it is produced from a single piece of fabric, which is subsequently folded and fastened in the desired form. This enables its production to be automated, allowing for fast and relatively cheap production. Despite this, the hat according to this invention may have an aesthetically appealing appearance, and its use may therefore increase compliance among those required to wear hats in the workplace. The shape of the hat makes it more suitable for use in situations in which the wearer may be visible to members of the public, and the hat may also carry branding or other promotional information.

Due to the use of a single piece of fabric in the manufacture of the hat according to this invention, there is minimal waste from offcuts of fabric during production and there is no need to ensure that multiple panels come from the same dye or print lot in order to maintain consistency of colour or shade. The use of a single piece of fabric limits the number of joins that are required to produce the hat; this enables hats according to this invention to be made of very lightweight fabric, resulting in a hat which is cool and comfortable for the wearer. The hat may be produced in a variety of colours, and more than one colour may be introduced into the fabric for each hat. Different colours and/or logos or other printed material may be included in the same production batch, which would not be possible in CMT processes. The hat according to this invention is additionally advantageous in that it may stretch to snugly fit the user's head, keeping hair in place and resulting in a comfortable fit, whilst retaining its shape and appearance. Elastication may permit the hat to be produced in a single, universal size suitable for all wearers. The hat may also be produced in a continuous process that enables printed material to be applied to the hat during manufacture. By using in-line printing processes, such as rotary screen or sublimation or digital printing, the printed material applied to the hats may be easily varied, facilitating the economical manufacture of printed hats, even in small-scale production runs.

By a "hat" is meant, in the context of the present invention, any item of headwear that is worn in commercial, medical or other institutional environments to cover the wearer's hair, eg for the purpose of hygiene and/or to carry branding or other promotional information. Such items may alternatively be referred to as caps or bonnets.

The fabric used in the manufacture of the hat may be a woven fabric or a non-woven fabric, but is more preferably produced by knitting. Suitable knitting methods will be familiar to those skilled in the art, but will typically involve the use of a flat bed knitting machine, eg a Raschel knitting machine.

Most commonly, the headband regions of the fabric, and hence of the finished hat, will be of greater stiffness and/or thickness than the at least one intermediate region.

The desired stiffness and/or thickness of the different regions of the fabric used to make the hat according to the invention may be obtained or adjusted using any of a number of methods familiar to those skilled in the art.

The different regions of the fabric used to make the hat may have differing densities of threads, or different patterns of threads, resulting in a stiffer or less stiff fabric as required. The stiffness of the fabric may be altered by incorporating yarns of differing weights into the different regions of the fabric. Technical yarns such as hollow yarns or channelled yarns may also be used, as may combinations of monofilament and filament yarns.

In addition, the stiffness of the fabric, or of selected regions of the fabric, may be increased by the use of stiffening or setting agents. The stiffening or setting agents may be incorporated into the fibres used to produce the fabric, or may be added to the surface of the fabric post-production. The parallel nature of the different regions in the fabric used to make the hat allow for the in-line application of stiffening or setting agents to a selected region or regions, eg a stiffening or setting agent may be applied to the headband region, but not to the at least one intermediate region. Such stiffening or setting agents may fill or block spaces in the structure of the fabric and so prevent or inhibit penetration of hair through the fabric. The application of stiffening or setting agents or the like may therefore result in regions of the fabric having a solid rather than open structure.

The incorporation of setting agents into the fabric used to produce the hat allows the style and/or design of the final hat to be modified. Such setting agents may also be used to aid in construction of the hat. Where the fabric is made from synthetic fibres the setting agents may take the form of a glue that sits on top of the fibres. Where the fabric is made from natural fibres, the setting agents may take the form of rice starch which is absorbed into the fibres. The use of setting agents allows varying degrees of stiffness to be introduced across the width or breadth of the fabric, which may aid in construction of the final hat and/or help to give the desired appearance.

In order to confer a more clearly defined shape on the finished hat, further elements may be introduced into the fabric from which the hat is made. For instance, stiffening ribs may be formed at the boundaries between the headband and intermediate regions of the fabric, by introducing lines of stitching or knitting-in of heavier gauge yarns or other such measures.

Shaping of the hat may also be promoted by the incorporation of one or more elastic elements, most commonly in the intermediate region. Such elastic elements may be introduced under tension, so that when they relax they cause the fabric to gather or pucker into a form that mimics the traditional shape of, for instance, a chef's toque. The elastic elements are typically elastic yarns that are knitted in to the structure of a knitted fabric.

The fabric from which the hat is made may be produced with specific features which enable different styles of hat to be produced, such as a chef's toque or a baker's hat. For example, multiple parallel regions of higher or lower density fabric may be incorporated into the single piece of fabric used to make the hat, resulting in the production of a hat with a variety of stiff and/or flexible regions, which are arranged such that the hat takes the desired shape.

Features which assist construction of the hat may also be introduced into the fabric. For instance, fold lines which aid in forming the shape of the finished hat may be formed by creating a line of weakness in the fabric, eg by the introduction of a narrow region which is of lower density than the surrounding fabric, or by forming a ridge in the fabric, eg by the introduction of a narrow region which is of higher density than the surrounding fabric.

The fabric used to make the hat according to the invention may have a degree of elasticity. This may be due to the use of a knitted structure and/or the incorporation of elastic fibres into the fabric during production. This may provide for elongation of the fabric, eg up to 25% or more, allowing for one size of hat to be produced to fit all users. In addition, elastic elements may be incorporated along the outer edges of the fabric, such that when the hat is produced they are situated along the lower edge of the hat. This further allows for one size of hat to fit all users snugly and comfortably, and provides for better retention of the wearer's hair. The use of textured yarns may also confer a degree of stretchability on the hat, enabling the hat to be produced in a single universal size.

Other features may be incorporated into the hat to increase comfort for the wearer. For example, a sweat band may be incorporated into the lower edge of the hat, such that it is in contact with the forehead of the wearer during use. The sweat band may be created by introducing an additional region into the fabric used to manufacture the hat. This additional region is formed as part of the headband region, and is of an absorbent nature. The additional region may be formed in a number of ways, for example by producing a thicker fabric, by using a different yarn, eg a microfiber or wick away fibre, by using a different knit construction which is designed to wick the moisture away from the user's forehead, or by using any combination of these methods.

The fabric used to make the hat according to the invention may be produced from pre-dyed yarns. This allows for the production of hats of a single colour, or for the production of hats with a design incorporated into the fabric of the hat. This may be particularly useful for the incorporation of branding or other promotional material into the final hat.

Where, as is preferred, the fabric is a knitted fabric, the various regions of the fabric may be produced by any of a number of suitable means, eg by employing multiple needle bars, by changing threading arrangements, using different yarns, different tensions or different patterning techniques, or a combination of these measures.

In certain embodiments, the fabric used in the manufacture of the hat according to the invention comprises two headband regions and one intermediate region. The headband regions may typically have widths of between 3 cm and 40 cm, more commonly between 5 cm and 30 cm. The width of the intermediate region may vary quite considerably, depending on the intended form of the finished hat, but is typically in the range 5 cm to 40 cm, more commonly 16 cm to 36 cm.

The headband regions may have a greater numerical density of yarns than the intermediate region, a different pattern of yarns than the intermediate region, and/or the headband regions may be formed using yarns of heavier gauge or stiffness or textured yarns.

In the manufacture of the hat according to the invention, the fabric is generally used in the form of a continuous strip, the headband regions being joined together at intervals along the length of the strip, the interval corresponding to the size of the finished hat.

Prior to joining of the headband regions, the fabric is preferably formed into the desired shape. This is most conveniently achieved by guiding the fabric over suitable formers that fold the fabric and bring the headband regions into juxtaposition. Most preferably, when the headband regions are brought together, the intermediate region lies between the headband regions so that its ends are captivated between the headband regions when the latter are joined together.

In an alternative embodiment, when the headband regions are brought together, the intermediate region is folded outside the headband regions such that it forms an inverted "V" shape over the headband regions when the latter are joined together.

Joining of the headband regions may be brought about by any suitable means, eg stitching, adhesive or (where the fabric comprises a thermally fusible material) welding. Stitching or ultrasonic welding may be particularly suitable.

A further advantage of the hat according to the invention is that the headband regions, which together constitute the headband of the hat, being of relatively dense knitted or woven structure, may be generally opaque and so may confer upon the hat an appearance that mimics that of a hat produced by a CMT process. The headband regions may also be of sufficiently dense structure that printing may be applied to them, enabling promotional, branding or other information to be applied to the hat. Such promotional, branding or other information may also be embroidered onto the hat.

The design of the hat may be modified in order to prevent hair poking through the fabric while the hat is being worn. This may be achieved, for instance, by producing the fabric used to manufacture the hat in such a way that the underside of the fabric (that side which, in the finished hat, will be worn next to the head), has a textured or uneven surface. The textured or uneven surface may be created by using a textured yarn, eg an air intermingled yarn, false twist yarn, multiple-ply yarn, KDK (knit-deknit) yarn or other similar yarn, and/or using an angular knit pattern eg a mesh. It is believed that the textured or uneven surface has the effect of catching the hair and effectively folding it back down to the head, preventing it from poking through the fabric. Other measures that may be taken to enhance retention of hair by the fabric include the use of polyester or other yarns that are electrostatically attracted to hair and/or the use of a pattern structure that allows the fabric to expand and contract in such a way that hairs are gripped by the fabric.

The side of the fabric that forms the external surface of the finished hat may have a smooth or a textured surface. That surface of the headband may be different to the corresponding surface of the at least one intermediate region. For example, external surface of the headband region may be smooth, giving a clean look and allowing for easy incorporation of branding or other promotional material onto the hat, and the at least one intermediate region may have a textured or uneven external surface.

As for conventional manufacture of headwear for use in catering and retail establishments, factories, pharmaceutical or cosmetic manufacturing establishments and the like, the hat according to the invention may incorporate one or more metal components, eg a knitted-in metal thread, to enable a hat to be detected should it inadvertently fall into, for instance, a foodstuff production or packaging line such that the hat contaminates the product being produced.

As is also known, the hat according to the invention may comprise one or more antimicrobial (antibacterial, antiviral or antifungal) agents to provide added sterility. To achieve this, the hat (or the fabric used in the manufacture of the hat) may be impregnated with a solution containing such an antimicrobial agent, or the hat may be formed from a fabric comprising yarn that incorporates an antimicrobial agent.

The hat according to the invention may also comprise other substances to improve durability and/or appearance. These include, but are not limited to, scents, odour-absorbing agents, anti-crease agents, waterproofing agents, softening agents, optical brighteners, fire retardant or flame-proofing agents, final finishing chemicals, or any combination of these. Such substances may be applied to or incorporated into part or the whole of the hat. This may be achieved by impregnating the hat (or the fabric used in the manufacture of the hat) with a solution containing such a substance, or the hat may be formed from a fabric comprising yarn that incorporates such a substance.

The fabric may also be designed to keep the wearer cool through the incorporation of coolants. Such coolants may be incorporated predominantly into the headband regions of the hat. Coolants may be integrated into the fabric itself, for example, by the incorporation of a proportion of Coolmax™ fibres into the fabric, or coolants may be applied to the surface of the fabric.

The workplaces where hats according to this invention may be worn, such as catering and retail establishments, factories and the like, often involve work which produces unpleasant odours, particularly from hot food work, eg frying chips. To counteract this, the hat (or the fabric used in the manufacture of the hat) may be impregnated with a scent or an odour-absorbing additive. These may be integrated into the fabric itself, for example, by impregnating the fibres used to produce the fabric with a scent or an odour-absorbing additive, or may be applied to the surface of the fabric from which the hat is made.

The hat according to the invention may be produced in a number of styles. The form of the hat may be dictated by the length and width of the fabric piece from which it is formed, and also by the relative widths of the headband and intermediate regions of the fabric. Typical embodiments of the hat according to the invention have the form of a garrison or forage cap, or a chef's toque.

According to a further aspect of the invention, there is provided a method of manufacturing a hat according to the first aspect of the invention, which method comprises the steps of a) providing a single piece of fabric, the single piece of fabric comprising parallel regions of fabric including first and second headband regions and at least one intermediate region, wherein the headband regions and the at least one intermediate region are of differing stiffness and/or thickness;
b) folding the piece of fabric such that the headband regions are brought together and the edges of the fabric are aligned;
c) joining the headband regions to form a headband; and, optionally,
d) severing the fabric at the points at which the headband regions are joined, to form discrete hats.

Where the fabric is severed, the discrete hats so formed may be packaged, either individually or in bulk, for supply to customers. Alternatively, the fabric may not be severed, and instead the hats may be supplied in connected form, eg wound into a roll or folded in concertina fashion. In such a case, individual hats are separated from the bulk supply by the end user, eg by tearing off. Suitable points or lines of weakness may be introduced to facilitate this.

Thus, according to a further aspect of the invention, there is provided a plurality of connected hats, each hat being formed from a single piece of fabric, the single piece of fabric comprising parallel regions of fabric including first and second headband regions and at least one intermediate region, the headband regions being joined at their ends to form a headband and the intermediate region forming the crown of the hat, wherein the headband regions and the at least one intermediate region are of differing stiffness and/or thickness, and the hats being joined together at junctions adjacent the ends of their headband regions to form a string of connected hats, such that a terminal hat may be separated from the string by severing of the string at the junction between that hat and the next hat in the string.

In a variant on the manufacturing method of the invention, a single piece of fabric is formed into an item of open-topped headwear, ie an item of headwear having no crown or an incomplete crown. Thus, according to another aspect of the invention, there is provided a method of manufacturing an item of open-topped headwear, which method comprises the steps of a) providing a single piece of fabric, the single piece of fabric comprising parallel first and second regions of fabric, b) cutting the single piece of fabric at intervals corresponding to the circumference required in the finished headwear to produce a headwear blank; and c) joining the cut ends of the headwear blank to form the item of open-topped headwear.

The steps may be performed in any appropriate order, eg, the ends of the headwear blank may be joined before it is cut from the single piece of fabric, or the blank may be cut and the ends then joined together.

The ends of the headwear blank may be joined by any suitable means, for example by ultrasonic welding or by stitching. Where the ends are joined by welding, the welding operation may simultaneously sever the fabric.

The length of the headwear blank may correspond to a multiple of the circumference required in the finished headwear, for example twice the circumference. The headwear blank may be folded, joined and cut such that multiple items of open-topped headwear are produced from one headwear blank.

Types of open-topped headwear that may be produced using this method include, but are not limited to, a bandana or an open-topped chef's toque.

In the production of an open-topped chef's toque, the first and second regions are different, and the first region is of higher density than the second region. The second region may incorporate one or more lines of a tensioning material, for instance elastic yarns, lengthways into the fabric. The fabric is cut at intervals corresponding to the circumference required in the finished headwear to produce a headwear blank, and the cut ends of the headwear blank are joined to form the open-topped chef's toque. The one or more lines of tensioning material cause the second region to gather and puff up into the conventional shape of a chef's toque.

Multiple open-topped chefs' toques may be produced from one headwear blank in the same manner as described above.

The invention will now be described in greater detail, by way of example only, with reference to the accompanying drawings, in which FIG. 1 shows part of an elongate knitted fabric piece used in the manufacture of a hat according to the invention;

FIGS. 2(*a*) and 2(*b*) show the manner in which the fabric piece of FIG. 1 is folded during manufacture of the hat;

Figure 5A:
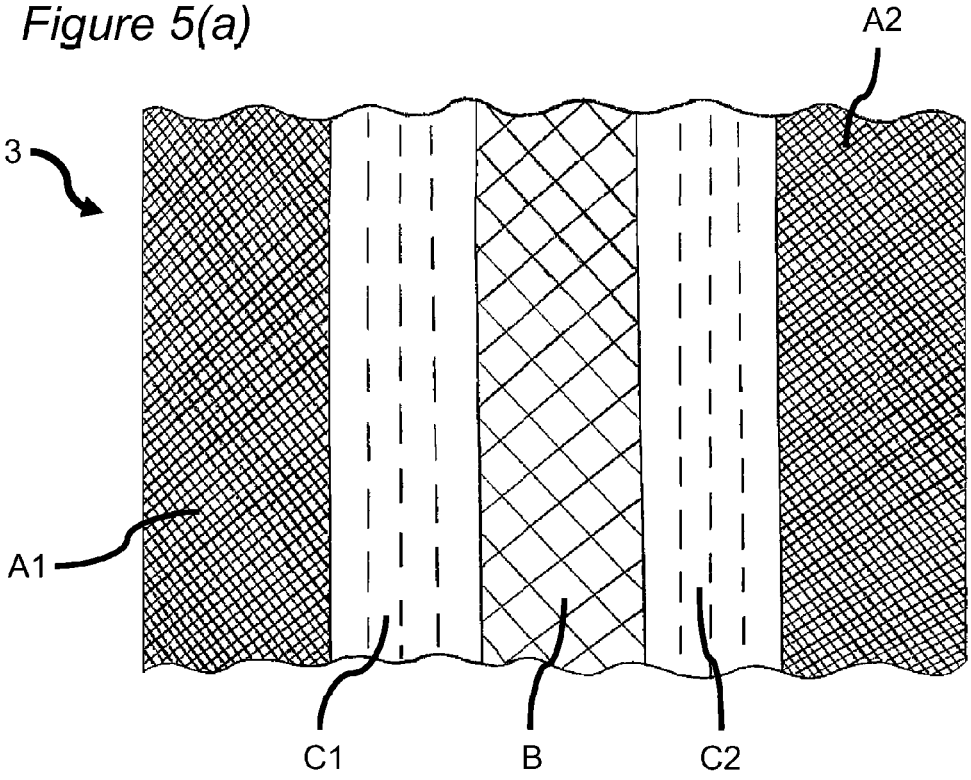
Figure 5B:
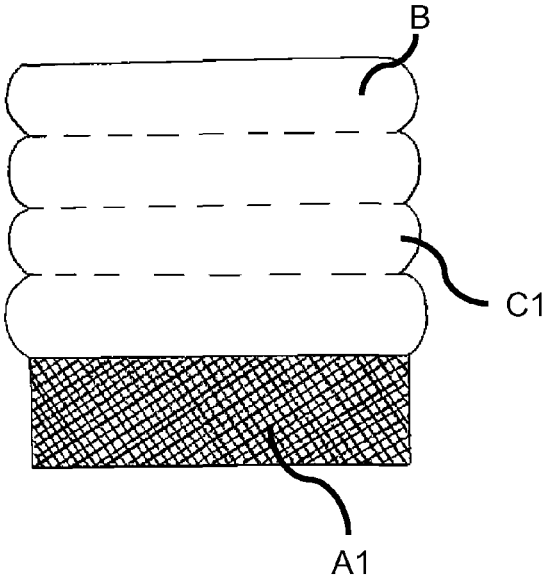

FIGS. 5(*a*) and 5(*b*) show a schematic drawing of a chefs' toque produced according to the invention.

Figure 1:
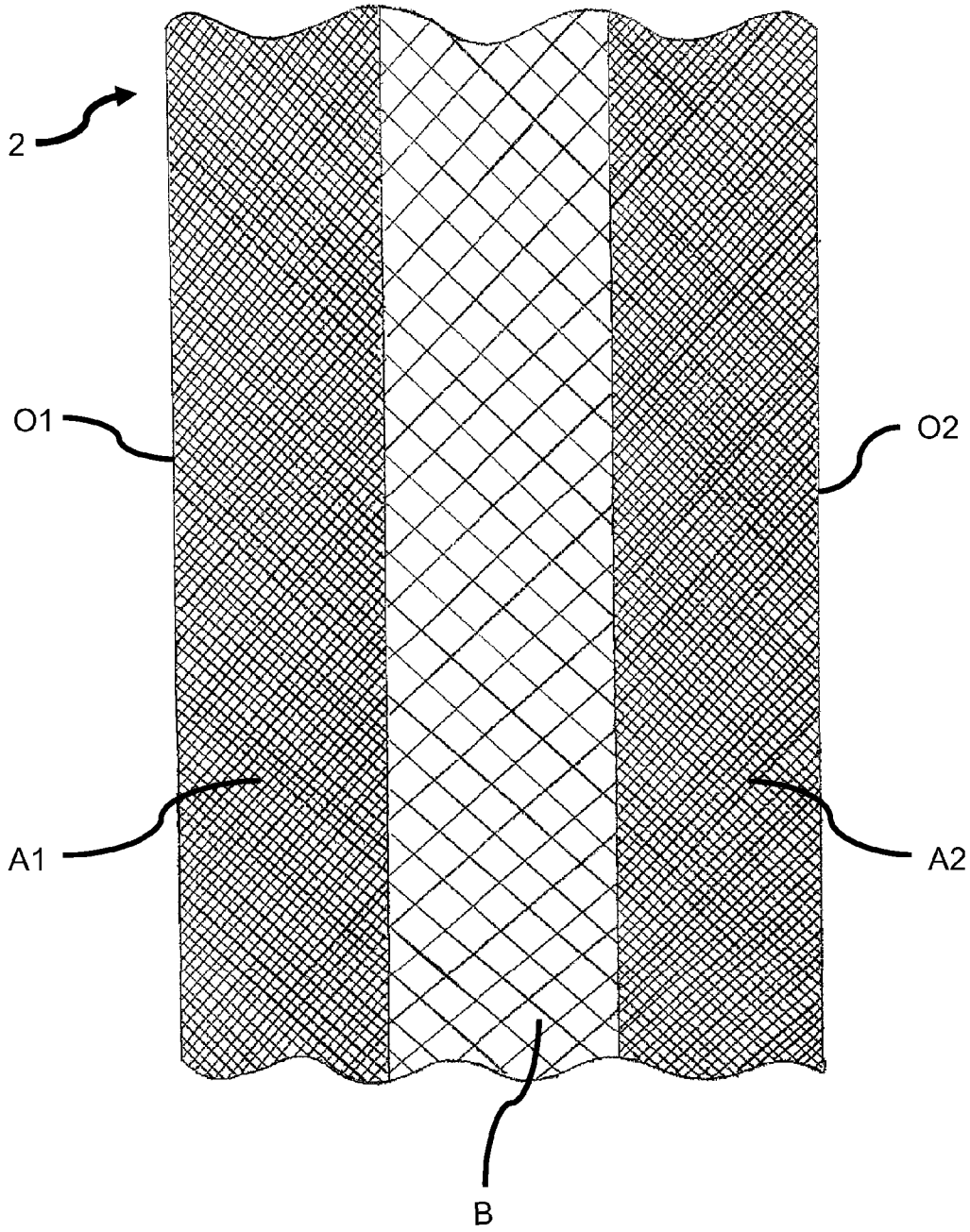
Figure 6A:
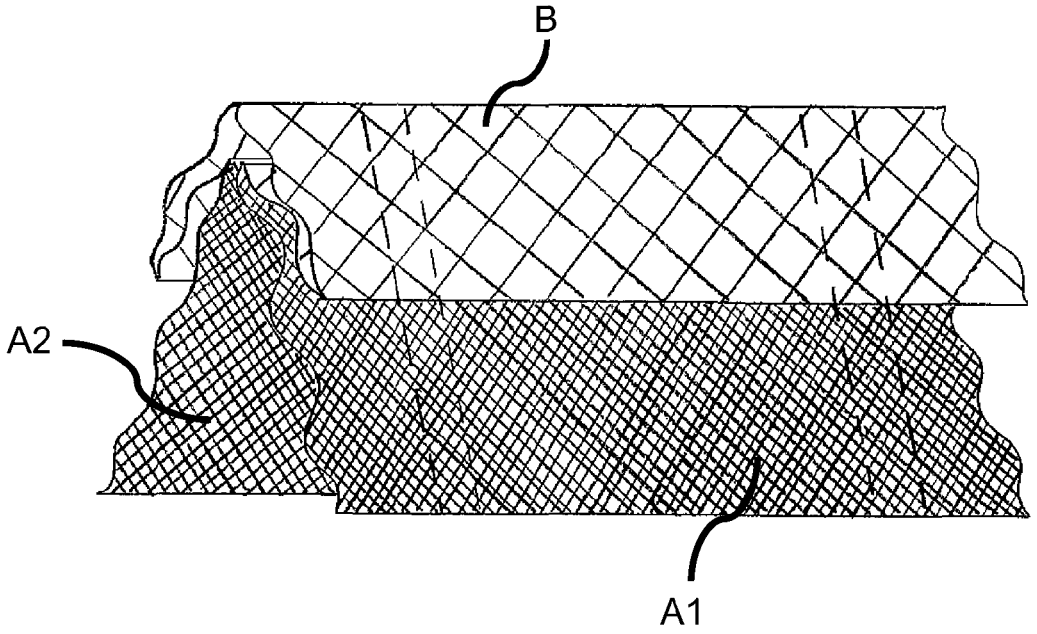
Figure 6B:
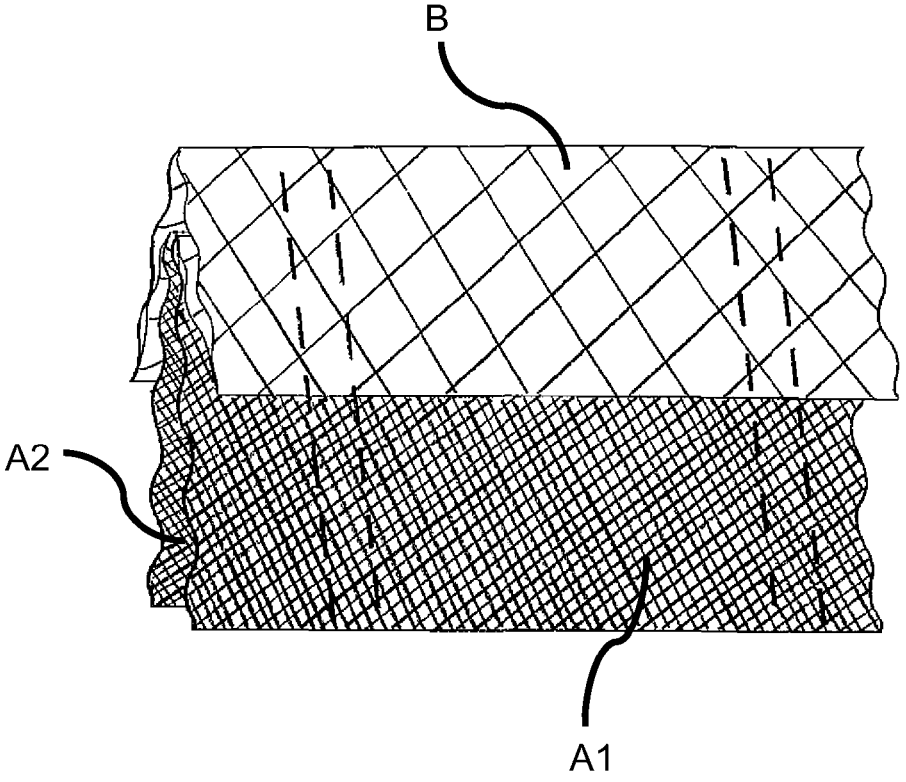

FIGS. 6(*a*) and 6(*b*) show an alternative manner in which the fabric piece of FIG. 1 may be folded during manufacture of the hat.

Figure 7A:
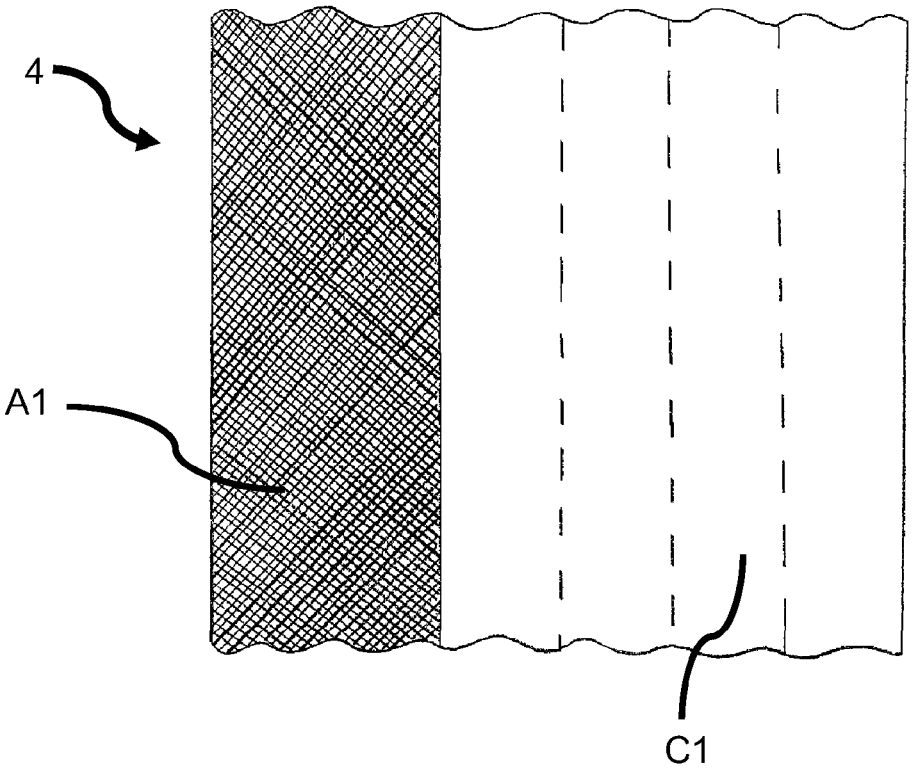
Figure 7B:
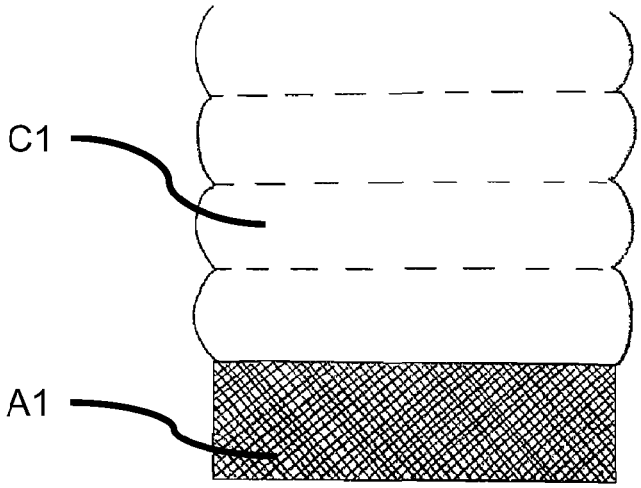

FIGS. 7(*a*) and 7(*b*) show a schematic drawing of an open-topped chefs' toque produced in accordance with the invention.

Figure 8A:
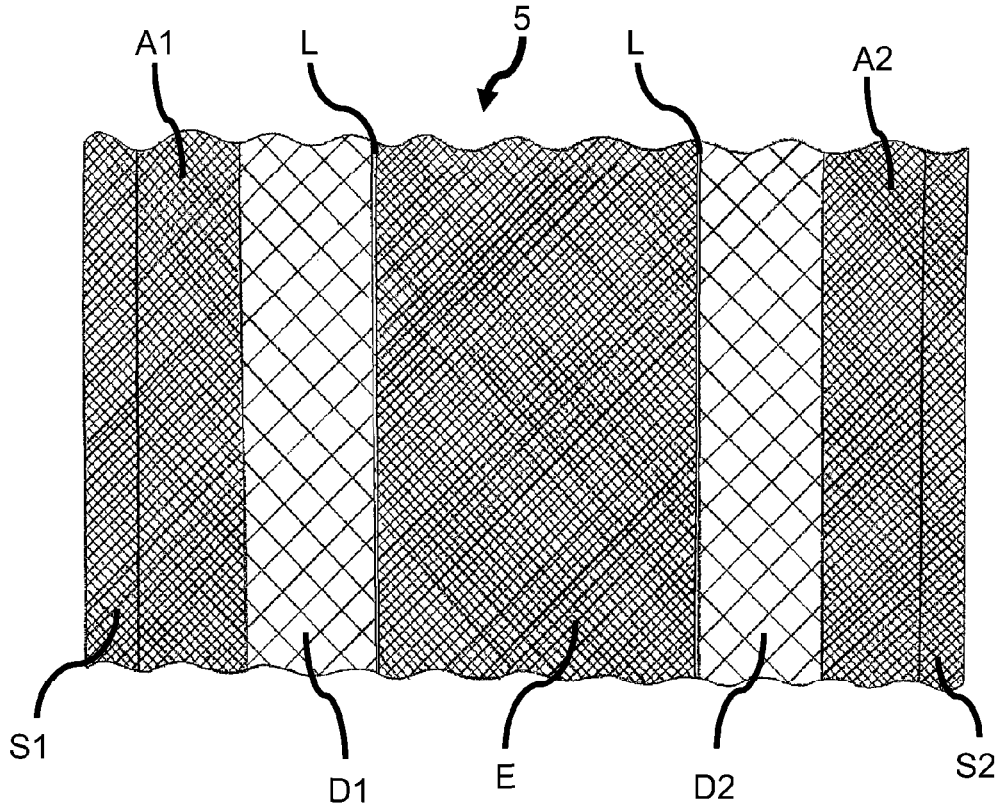
Figure 8B:
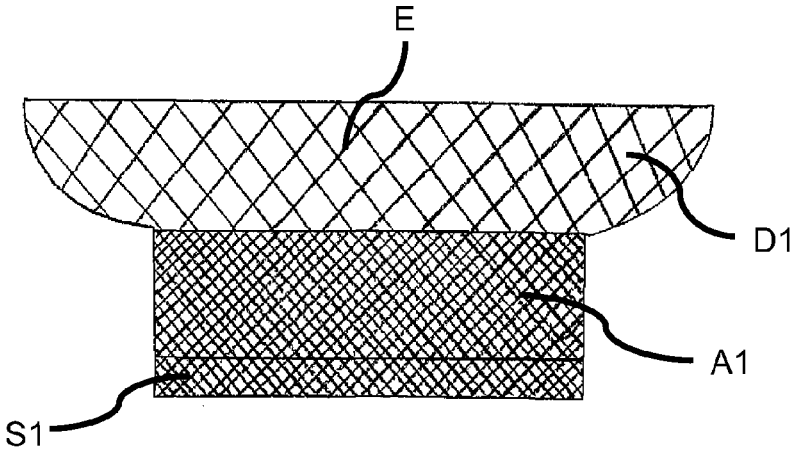

FIGS. 8(*a*) and 8(*b*) show a schematic drawing of an alternative style of hat produced according to the invention.

Referring first to FIG. 1, a hat suitable for use in commercial or other establishments in which workers are required to cover their hair is produced from a single piece of fabric 2. The fabric 2 is knitted as a continuous strip with an overall width of approximately 25 cm, and comprises three distinct longitudinally extending regions A1,A2,B of approximately equal width. The headband regions A1,A2 have a relatively dense knitted structure, whereas the intermediate region B has a considerably less dense and more open knitted structure.

The fabric 2 is knitted in generally conventional manner using a Raschel knitting machine.

Figure 2A:
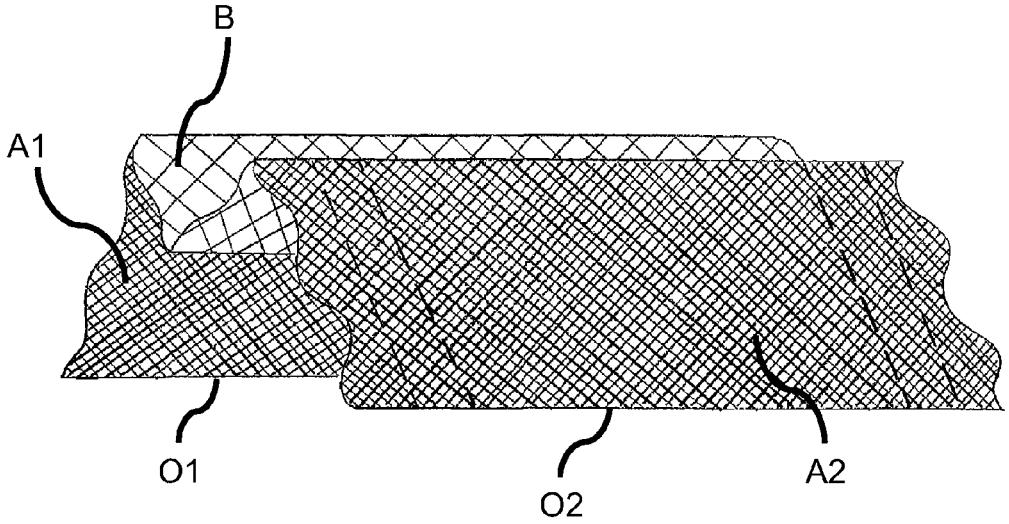
Figure 2B:
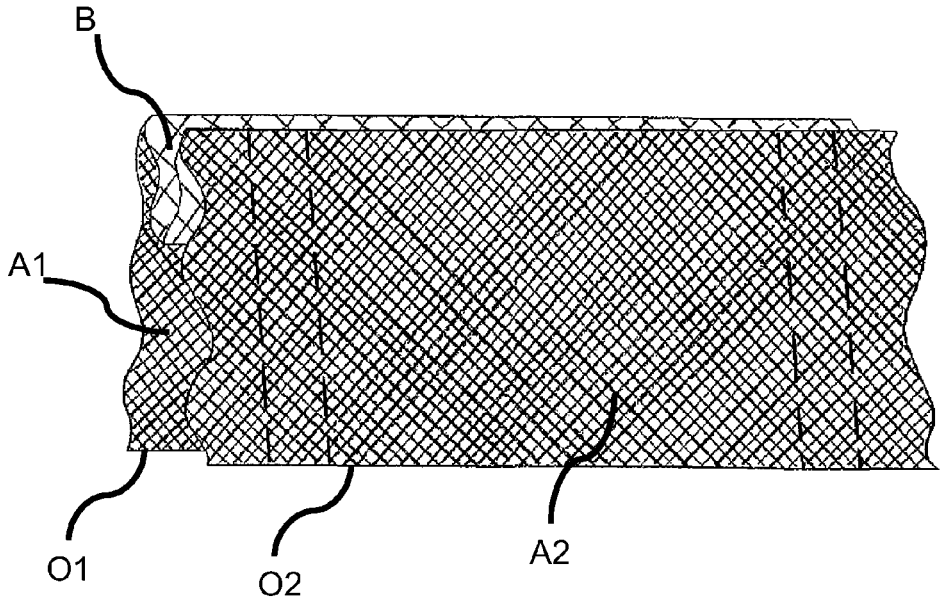

In order to form the hat, the fabric 2 is passed over a suitably shaped former, so that it is folded in the manner depicted in FIGS. 2(*a*) and 2(*b*), ie the two headband regions A1,A2 are brought together with the intermediate region B folded between them and the outer edges of the fabric 2 lying adjacent to each other The two headband regions A1,A2 are then joined together along the broken lines indicated in FIGS. 2(*a*) and 2(*b*). In the illustrated embodiment, this is achieved by two lines of stitching, but alternative means such as ultrasonic welding may also be used.

Finally, individual hats may be separated from the fabric 2 by cutting. To facilitate this, the fabric 2 is cut between the double lines of stitching. Where the headband regions are joined together by welding, the welded join may be made sufficiently wide that a cut may be made along its centre.

Figure 3:
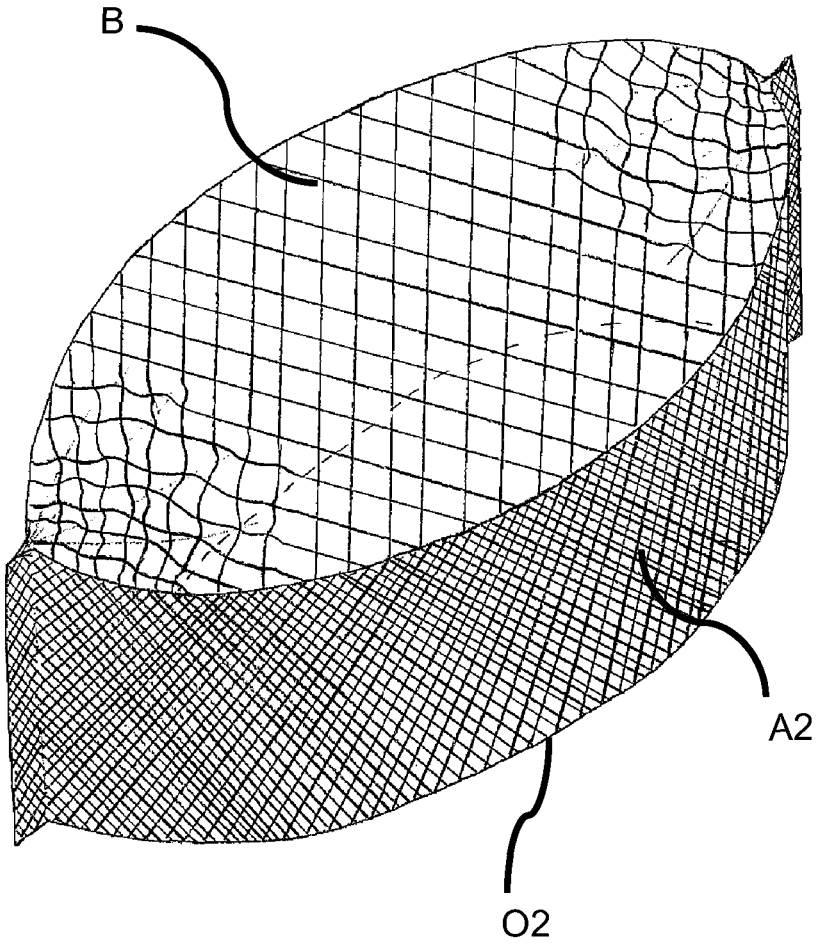
FIG. 3 is a perspective view of a hat produced in accordance with the invention.

The finished hat is shown in FIG. 3. The headband regions A1,A2 of the fabric are joined to form a headband that fits closely to a wearer's head. Being formed of a knitted fabric, the headband is able to stretch so as to fit differently sized heads. The intermediate region B of the fabric constitutes the crown of the hat. Being of lighter, more open structure, the crown portion allows breathability and flexibility, preventing the user from becoming too warm. The two headband regions have a denser structure, which makes them generally opaque and which confers on the hat a shape akin to that of a hat made by a more complex CMT process. The headband regions may be printed with branding or other promotional information.

It will be appreciated that although in the illustrated embodiment the crown portion of the hat has a very open structure and the headband regions have a denser (though still somewhat open) structure, in other embodiments one or more of the respective regions of the fabric may be coated with a stiffening or setting agent or the like, the effect of which is to give those region(s) a solid or continuous surface.

Elastic elements may optionally be incorporated into the fabric 2 along its outer edges O1, O2, such that in the finished hat the elastic elements are situated along the lower edge of the hat as illustrated in FIG. 3. This allows for one size of hat to fit all users snugly and comfortably. Such elastic elements may take various forms. For instance, they may be discrete elastic yarns that are incorporated into the knitted structure of the fabric, or the knitted ground structure may include such yarns or fibres.

In an alternative process, rather than individual hats being cut off at the point of manufacture, the hats may be supplied in the form of a string of hats, individual hats being separated by lines of weakness such that individual hats may be separated from the string, eg by being torn off immediately prior to use. An example of such a string of hats is shown in FIG. 4.

Figure 4:
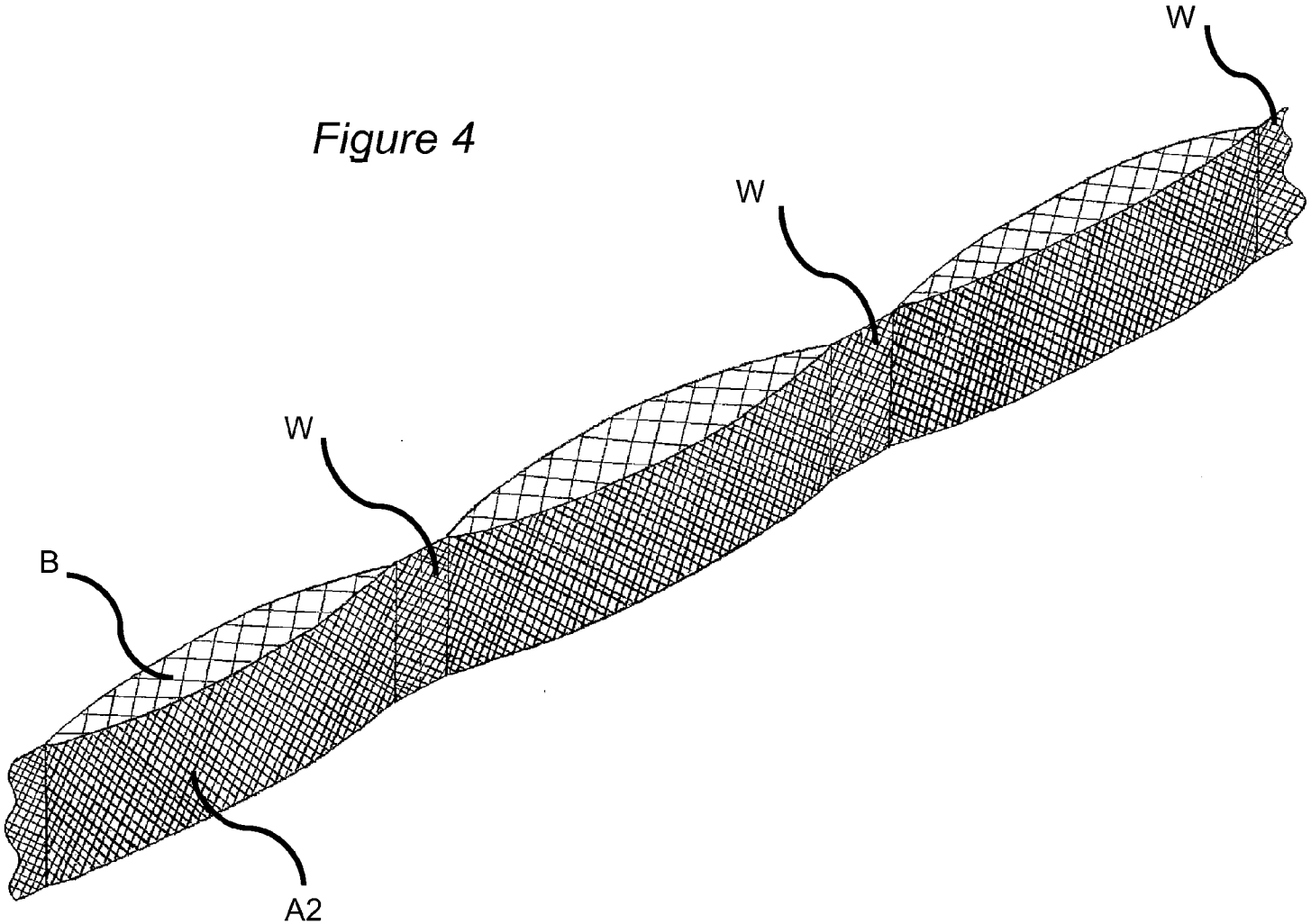
FIG. 4 shows part of a string of connected hats produced in accordance with the invention.

The string of hats shown in FIG. 4 is formed as described above with reference to FIGS. 1 to 3, but individual hats are not separated from the fabric at the point of manufacture. During production, the two outer portions A1, A2 are joined together at intervals using ultrasonic welding, resulting in the formation of welds W as shown in FIG. 4. The welds are approximately 1 cm in width and, in order to facilitate the subsequent separation of hats from the string, perforations are introduced down the centre of each weld W, as indicated by the broken lines in FIG. 4. This allows an individual hat to be easily torn from the end of the string.

The string of hats may be formed into, for example, a roll that can be fitted into a suitable dispenser that can be installed at a workplace and from which individual hats may be drawn, eg by employees arriving at the workplace. Alternatively, the string of hats may be supplied folded in a concertina-like arrangement. This may be fitted into a suitable box or dispenser, from which individual hats can be drawn as required.

The invention may be adapted to produce different styles of hats. For example, a schematic diagram of a chefs' toque produced according to the invention is shown in FIGS. 5(*a*) and 5(*b*). The fabric 3 used to produce the hat is knitted as a continuous band, and comprises the regions A1, A2 and B as described with reference to FIG. 1, and gathered regions C1,C2. Gathered regions C1,C2 have one or more lines of elastic incorporated into the fabric, as indicated by the broken lines in FIG. 5(*a*).

In order to form the chefs' toque, the fabric 3 is passed over a suitably shaped former, so that it is folded in a manner analogous to that depicted in FIGS. 2(*a*) and 2(*b*), ie the two headband regions A1,A2 are brought together, and the two gathered regions C1,C2, are brought together with the intermediate region B folded between them and the outer edges of the fabric 3 lying adjacent to each other.

The two headband regions A1,A2 and the two gathered regions C1,C2 are then joined together in a manner analogous to joining along the broken lines indicated in FIGS. 2(*a*) and 2(*b*). In the illustrated embodiment, this is achieved by two lines of stitching, but alternative means such as ultrasonic welding may also be used.

Finally, individual hats may be separated from the fabric 3 by cutting. To facilitate this, the fabric 3 is cut between the double lines of stitching. Where the headband and gathered regions are joined together by welding, the welded join may be made sufficiently wide that a cut may be made along its centre. Alternatively, the welding operation may simultaneously cut the fabric.

The gathered regions C1,C2 provide the chefs' toque with height, and the lines of elastic cause the hat to puff out in the conventional style as illustrated in FIG. 5(*b*). The height of the toque may be adjusted by altering the number of lines of elastic and/or the spacing between them. The intermediate region B forms the crown of the toque.

Alternatively, a hat according to the invention may be formed by passing the fabric 2 over a suitably shaped former, so that it is folded in the manner depicted in FIGS. 6(*a*) and 6(*b*) ie the two headband regions A1,A2 are brought together with the intermediate region B folded such that it forms an inverted "V" shape over the headband region, with the outer edges of the fabric 2 lying adjacent to each other. The two headband regions A1,A2 are then joined together along the broken lines indicated in FIGS. 6(*a*) and 6(*b*). This method of folding may also be adapted for other styles of hat such as the chefs' toque.

The hat according to the invention may also be an item of open-topped headwear, such as an open-topped chefs' toque, as illustrated in FIGS. 7(*a*) and 7(*b*). The fabric 4 used to produce the hat is knitted as a continuous stream, and comprises the headband region A1 as described with reference to FIG. 1, and gathered region C1 as described with reference to FIG. 5(*a*).

To form the open-topped chefs' toque, the fabric 4 is cut to a length corresponding to the circumference required in the finished headwear, and folded so that the two ends of the headband region A1 are brought together and the two ends of the gathered region C1 are brought together, forming a loop. The two ends of the headband region A1 are joined together, and the two ends of the gathered region C1 are joined together. This may be achieved by any suitable means, including stitching or ultrasonic welding.

The gathered region C1 provides the open-topped chefs' toque with height and causes it to puff out in the conventional style. The height of the toque may be adjusted by altering the number of lines of elastic and/or the spacing between them.

A schematic drawing of an alternative style of hat that may be produced according to the invention is shown in FIG. 8(*b*). The fabric 5 used to produce the hat is knitted as a continuous band, and comprises headband regions A1 and A2 as described with reference to FIG. 1; flexible regions D1,D2; crown region E, and sweatband regions S1,S2 as shown in FIG. 8(*a*). Headband regions A1,A2 and crown region E have a higher density of knitted or woven threads than flexible regions D1, D2. Sweatband regions S1,S2 form part of headband regions A1,A2, and may be created by producing a thicker fabric, using a different yarn, eg a microfiber or wick away fibre, using a different knit construction which is designed to wick the moisture away from the user's forehead, or by using any combination of these methods. The width of the crown region E is larger than the desired diameter of the finished hat.

At the junction between regions D1 and E, and between regions E and D2, there are fold lines L incorporated into the fabric 5. These may take the form of a line of weakness in the fabric, eg by the introduction of a line which is of lower density than the surrounding fabric, or a ridge in the fabric, eg by the introduction of a line which is of higher density than the surrounding fabric.

To form the alternative style of hat, the fabric 5 is passed over a suitably shaped former, so that it is folded in a manner analogous to that depicted in FIGS. 6(*a*) and 6(*b*) ie the two headband regions A1,A2 are brought together with the flexible regions D1,D2 and the crown region E folded such that they form an inverted "V" shape over the headband region, with the outer edges of the fabric 5 lying adjacent to each other. The two headband regions A1,A2 are then joined together along the broken lines indicated in FIGS. 6(*a*) and 6(*b*). In the illustrated embodiment, this is achieved by two lines of stitching, but alternative means such as ultrasonic welding may also be used.

Finally, individual hats may be separated from the fabric 5 by cutting. To facilitate this, the fabric 5 is cut between the double lines of stitching. Where the headband regions are joined together by welding, the welded join may be made sufficiently wide that a cut may be made along its centre.

The invention claimed is:

1. A hat formed from a single piece of fabric, the single piece of fabric comprising:

parallel regions of fabric including first and second headband regions; and at least one intermediate region, the first and second headband regions being joined at their ends to form a headband and the intermediate region forming a crown of the hat, wherein the first and second headband regions and the at least one intermediate region have at least one of differing densities of threads, different patterns of threads, and yarns of differing weights.

2. The hat according to claim 1, wherein the first and second headband regions are of greater stiffness, greater thickness, or both greater stiffness and thickness than the at least one intermediate region.

3. The hat according to claim 1, wherein a stiffening agent or a setting agent is applied to at least selected regions of the fabric.

4. The hat according to claim 1, wherein the first and second headband regions have widths of between 3 cm and 40 cm and the at least one intermediate region has a width of between 5 cm and 40 cm.

5. The hat according to claim 1, wherein the single piece of fabric comprises two headband regions and one intermediate region.

6. A hat formed from a single piece of fabric, the single piece of fabric comprising:

parallel regions of fabric including first and second headband regions; and at least one intermediate region, the first and second headband regions being joined at their ends to form a headband and the intermediate region forming a crown of the hat, wherein the first and second headband regions are formed using yarns of heavier gauge or stiffness than the intermediate regions.

7. The hat according to claim 1, wherein the first and second headband regions are joined at the ends by stitching or by ultrasonic welding.

8. The hat according to claim 1, wherein the fabric from which the hat is made comprises one or more of stiffening elements, an elastic element and a metal component.

9. The hat according to claim 1, wherein the fabric from which the hat is made comprises one or more substances selected from the group of: scents, odour-absorbing agents, anti-crease agents, waterproofing agents, softening agents, optical brighteners, fire retardant or flame-proofing agents, and final finishing chemicals.

10. The hat according to claim 1, which is in the shape of a garrison cap or a chef's toque.

11. A method of manufacturing a hat comprising:

a) providing a single piece of fabric, the single piece of fabric comprising parallel regions of fabric including first and second headband regions and at least one intermediate region, wherein the first and second headband regions and the at least one intermediate region have at least one of differing densities of threads, different patterns of threads, and yarns of differing weights;

b) folding the piece of fabric such that the first and second headband regions are brought together and edges of the fabric are aligned; and c) joining the first and second headband regions to form a headband severing the fabric at the points at which the headband regions are joined, to form discrete hats.

12. The method according to claim 11 further comprising forming the fabric into a desired shape prior to joining of the first and second headband regions.

13. The method according to claim 11, wherein the fabric is used in a continuous strip.

14. The method according to claim 13, wherein the first and second headband regions are joined together at intervals along a length of the continuous strip, the intervals corresponding to a size of the finished hat.

15. The method according to claim 11, wherein, when the first and second headband regions are brought together, the intermediate region lies between the first and second headband regions so that ends are captivated between the first and second headband regions when the first and second headband regions are joined together.

16. The method according to claim 11, wherein, when the first and second headband regions are brought together, the intermediate region is folded outside the first and second headband regions to form an inverted "V" shape over the first and second headband regions when the first and second headband regions are joined together.

17. The method according to claim 11, wherein the first and second headband regions are joined by stitching or by ultrasonic welding.

18. The method according to claim 11, wherein the single piece of fabric incorporates at least one of stiffening elements, elastic elements and metal components.

19. The method according to claim 11, wherein the single piece of fabric incorporates one or more antimicrobial agents.

20. The method according to claim 11, further comprising applying printed material to the hat.

21. A plurality of connected hats, each hat being formed from a single piece of fabric, the single piece of fabric comprising parallel regions of fabric including first and second headband regions and at least one intermediate region, the first and second headband regions being joined at ends to form a headband and the intermediate region forming a crown of the hat, wherein the first and second headband regions and the at least one intermediate region have at least one of differing densities of threads, different patterns of threads, and yarns of differing weights, the plurality of connected hats being joined together at junctions adjacent the ends of the first and second headband regions to form a string of connected hats, such that a terminal hat may be separated from the string by severing of the string at a junction between one hat and a next hat in the string.

22. The plurality of hats according to claim 21, wherein the first and second headband regions are joined using ultrasonic welding.

23. The plurality of hats according to claim 21, wherein the junction between two hats in the string is a line of weakness.

24. The plurality of hats according to claim 23, wherein the line of weakness is a line of perforations.

25. The plurality of hats according to claim 21, wherein the plurality of connected hats are supplied in a roll.

26. The plurality of hats according to claim 21, wherein the plurality of connected hats are supplied in a concertina arrangement.

* * * * *